US006213841B1

(12) United States Patent
Kuo

(10) Patent No.: US 6,213,841 B1
(45) Date of Patent: Apr. 10, 2001

(54) CUP STRUCTURE FOR A BRA

(76) Inventor: Jui-Kun Kuo, No. 51, Shou Shan Rd., Kuei Shan Hsiang, Taoyuan Hsien (TW)

( * ) Notice: Subject to any disclaimer, the term of this patent is extended or adjusted under 35 U.S.C. 154(b) by 0 days.

(21) Appl. No.: 09/493,289

(22) Filed: Jan. 28, 2000

(51) Int. Cl.[7] ..... A41C 3/10
(52) U.S. Cl. ..... 450/55; 450/1
(58) Field of Search ..... 450/1, 38, 53, 450/54, 55, 56, 57, 58

(56) References Cited

U.S. PATENT DOCUMENTS 2,627,606 * 2/1953 DeGrandis ..... 455/57
2,902,695 * 9/1959 Werner ..... 2/267
3,304,558 * 2/1967 Mann ..... 455/57
3,356,090 * 12/1967 Plantinga et al. ..... 455/57
4,019,209 * 4/1977 Spence ..... 623/7
5,098,330 * 3/1992 Greenberg ..... 450/55

* cited by examiner

*Primary Examiner*—Gloria M. Hale
(74) *Attorney, Agent, or Firm*—Pro-Techtor International Services

(57) ABSTRACT

A cup structure for a bra includes a front fabric, a rear fabric, and a soft pad between the front fabric and the rear fabric. The front fabric includes a first layer of woven cloth and a first layer of foam material engaged to an inner surface of the first layer of woven cloth. The second fabric includes a second layer of woven cloth and a second layer of foam material engaged to an outer surface of the second layer of woven cloth. An overall outer surface of the soft pad is adhered to a mediate portion of the first layer of foam material and to a mediate portion of the second layer of foam material. A peripheral edge of first layer of foam material is directly bonded with a peripheral edge of the second layer of foam material.

2 Claims, 5 Drawing Sheets

CUP STRUCTURE FOR A BRA

BACKGROUND OF THE INVENTION

1. Field of the Invention

The present invention relates to a cup structure for a bra.

2. Description of the Related Art

A bra includes two cups each having a pad sewed therein to provide comfort wearing for the users. Typical bras include fixed silicone rubber type pad and soft pad. A soft pad includes two tough thin films containing liquid therein in a sealed manner. Each cup must be provided with a deep pocket for receiving the soft pad. It is, however, found that the soft pad cannot be properly positioned without deviation or skew.

FIG. 1 of the drawings illustrates a bra with a conventional cup 10. A soft pad is sewn onto an inner surface of a lining fabric of each cup 10. The soft pad 11 includes two tough thin films containing liquid therein in a sealed manner. The liquid includes water or oil. Nevertheless, sewing the soft pads 11 is time-consuming and labor-intensive. In addition, the soft pads 11 are often stabbed and thus cause leakage. Further, the soft pads are only sewn in the peripheral edges thereof and thus fail to provide reliable positioning.

The present invention is intended to provide a cup structure for a bar that mitigates and/or obviates the above problems.

SUMMARY OF THE INVENTION

It is a primary object of the present invention to provide an improved cup structure for a bra, wherein the cup structure includes a front fabric and a rear fabric. Each fabric includes a layer of woven cloth and a layer of foam material engaged on a surface of the layer of woven cloth. The two layers of foam material face each other such that a soft pad may be adhered to a mediate portion of each of the two layers of foam material. The overall outer surface of the soft pad is directly adhered between the mediate portions of the layers of foam material. A peripheral edge of the layer of foam material of the front fabric is directly bonded with a peripheral edge of the layer of foam material of the rear fabric. Thus, the soft pad is reliably positioned between the front fabric and the rear fabric, and the assembly efficiency is improved.

Other objects, advantages, and novel features of the invention will become more apparent from the following detailed description when taken in conjunction with the accompanying drawings.

DETAILED DESCRIPTION OF THE PREFERRED EMBODIMENTS

Figure 1:
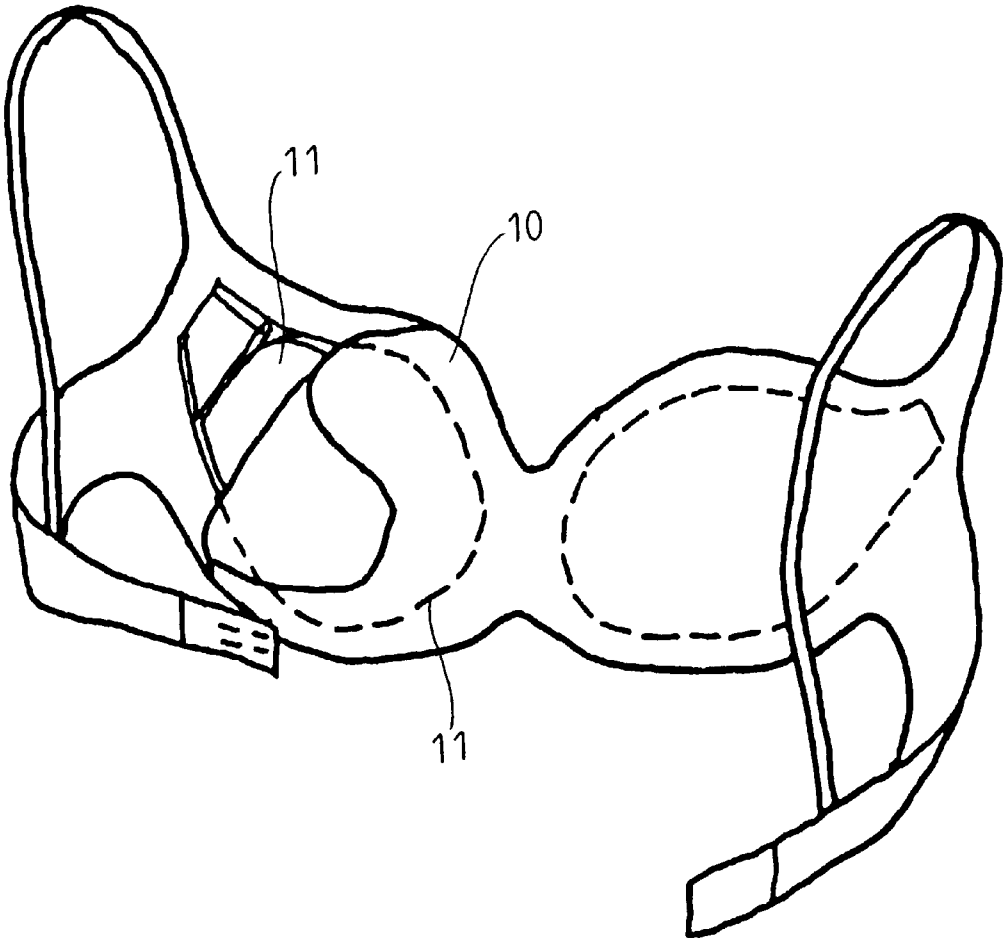
FIG. 1 PRIOR ART
FIG. 1 is a perspective view of a conventional bra.
Figure 2:
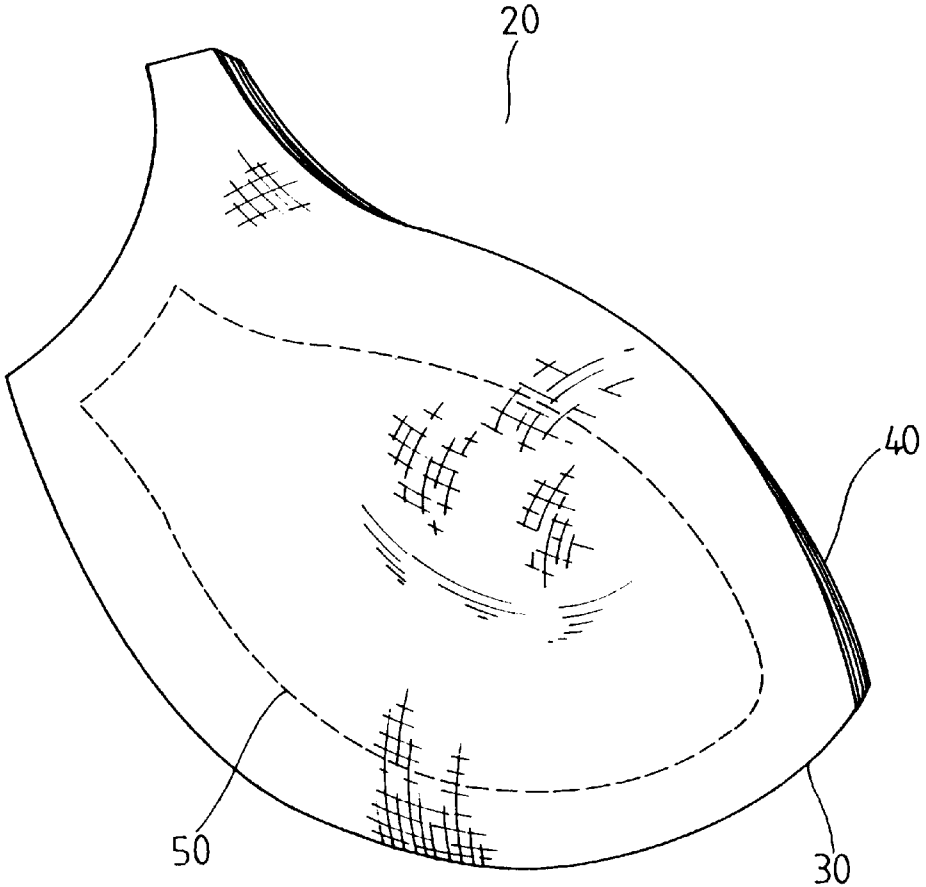
FIG. 2 is a perspective view of a cup structure in accordance with the present invention.
Figure 3:
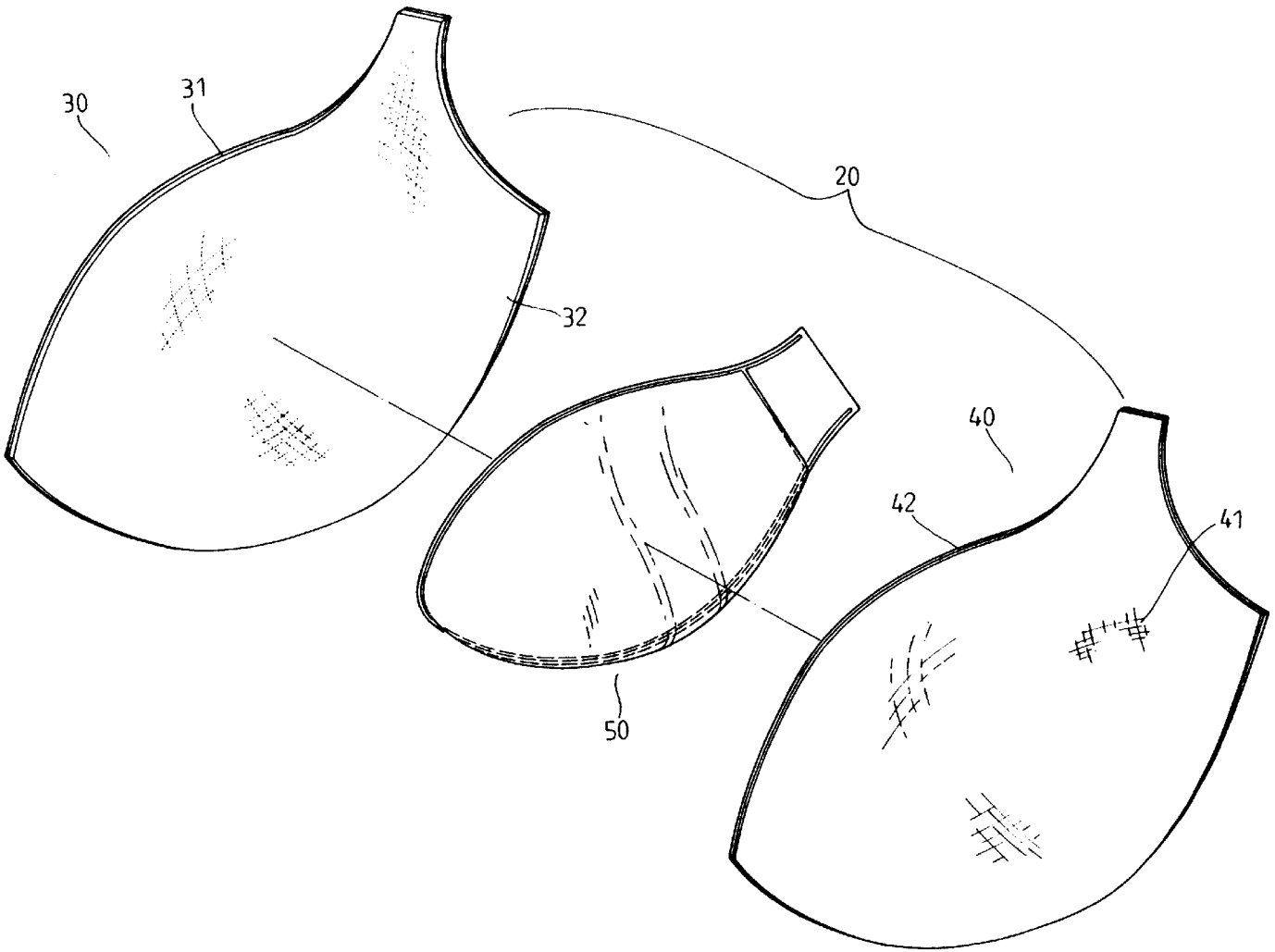
FIG. 3 is an exploded perspective view of the cup structure in accordance with the present invention.

Referring to FIGS. 2 and 3, a cup structure 20 in accordance with the present invention generally includes a front fabric 30, a rear fabric 40, and a soft pad 50 between the front fabric 30 and the rear fabric 40.

Each fabric 30, 40 includes a layer of woven cloth 31, 41 and a layer of foam material 32, 42 engaged on a surface of the layer of woven cloth 31, 41. The layers of foam material 32 and 42 face each other. It is appreciated that the width of the layer of foam material of the front fabric 30 is larger than that of the layer of foam material of the rear fabric 40.

Figure 4:
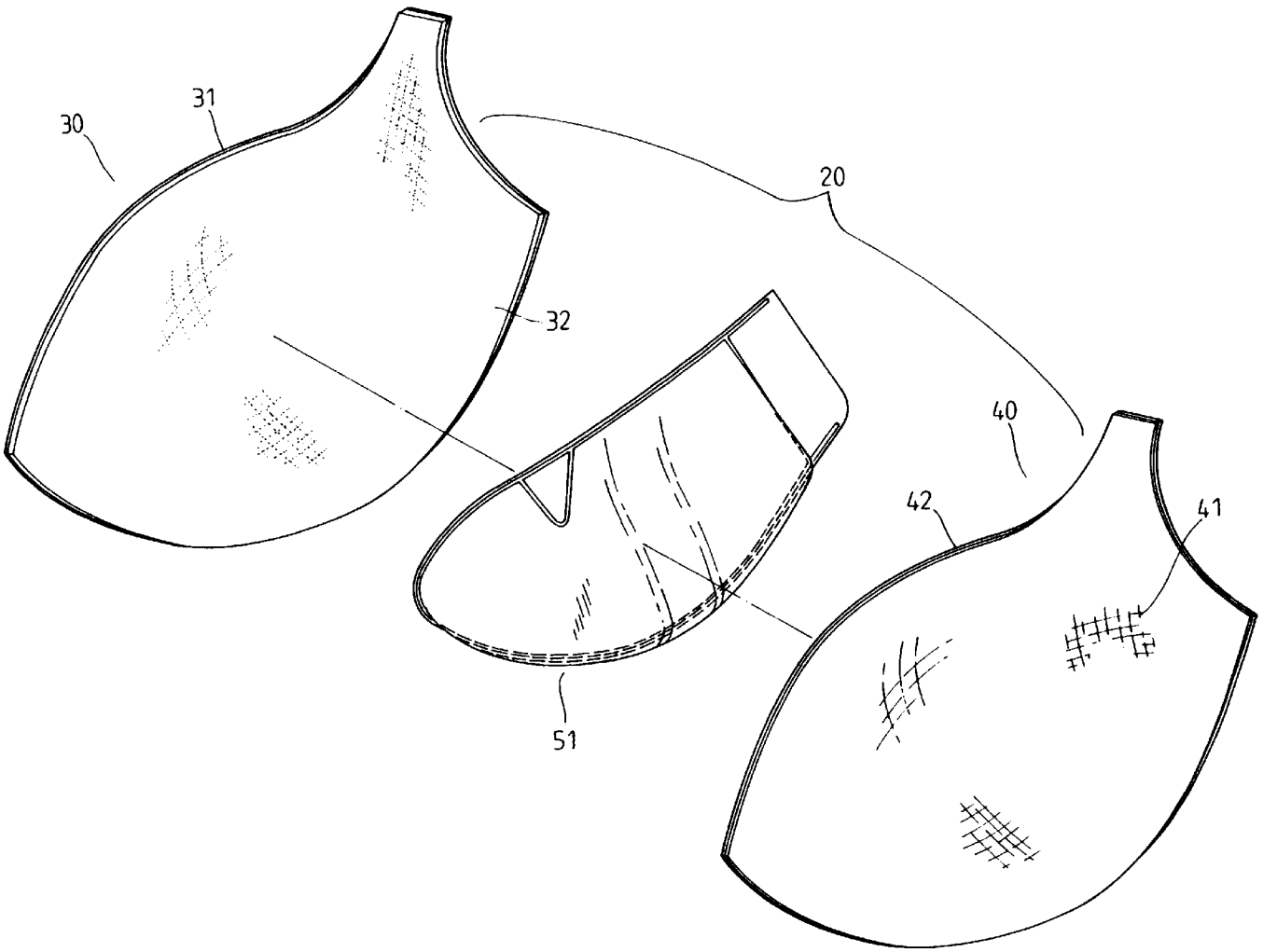
FIG. 4 is an exploded perspective view of a modified embodiment of the cup structure in accordance with the present invention.

The soft pad 50 includes two tough thin films containing liquid therein in a sealed manner. The liquid includes water or oil that has high flowability. The soft pad (now designated by 51) in FIG. 4 uses powder of milk-like liquid to thereby provide a light structure.

The soft pad 50 is sandwiched between the front fabric 30 and the rear fabric 40. Adhesive is applied to an overall outer surface of the soft pad 50 so as to be bonded with mediate portions of the layers of foam material 32 and 42. A peripheral edge of the layer of foam material 32 of the front fabric 30 is directly bonded with a peripheral edge of the layer of foam material 42 of the rear fabric 40. Thus, a composite cup structure 20 is provided.

Figure 5:
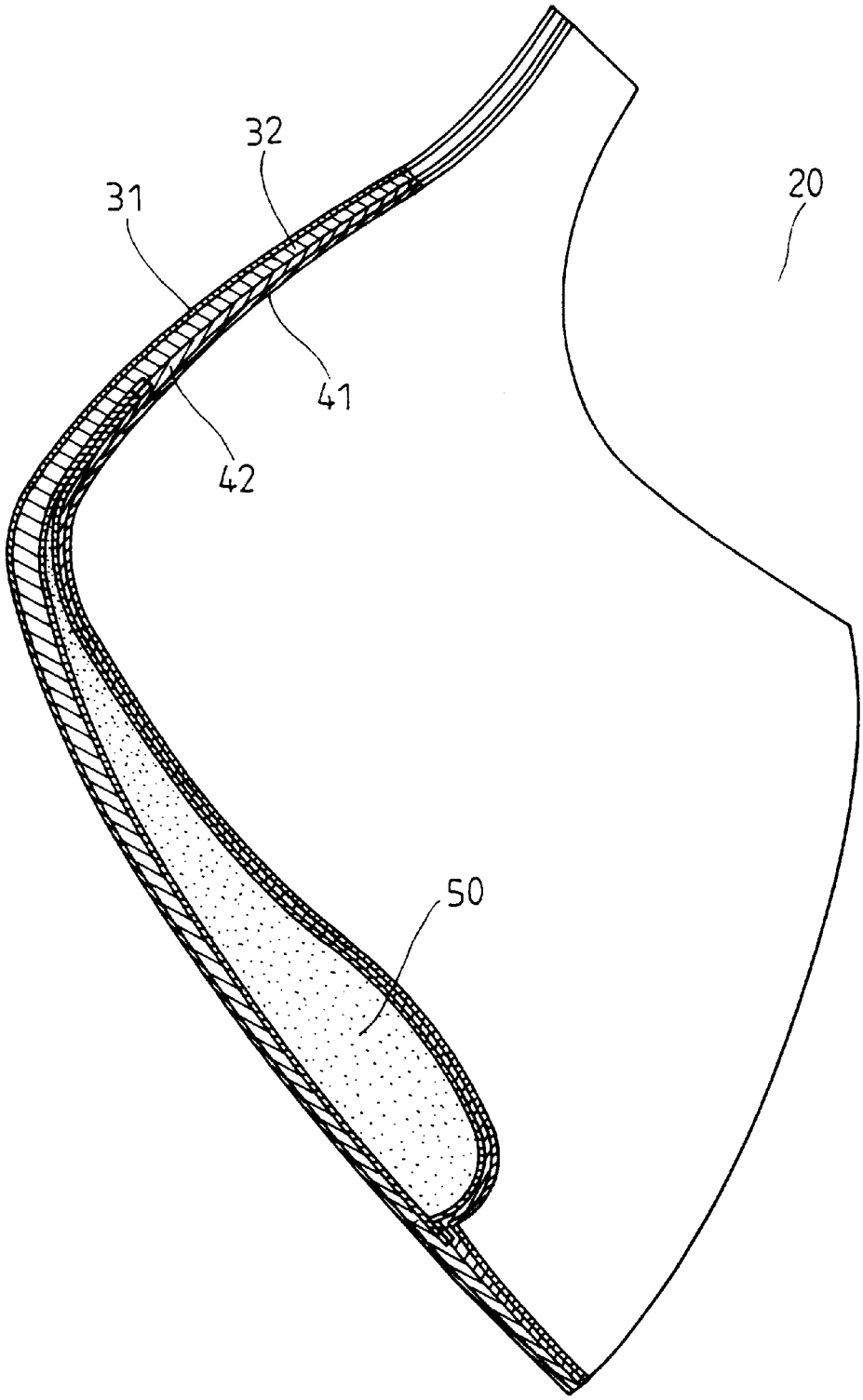
FIG. 5 is a sectional view of the cup structure in accordance with the present invention.

As illustrated in FIG. 5, the soft pad 50 is adhered between the layer of foam material 32 of the front fabric 30 and the layer of foam material 42 of the rear fabric 40 in a reliable manner without deviation or skew.

Although the invention has been explained in relation to its preferred embodiment, it is to be understood that many other possible modifications and variations can be made without departing from the spirit and scope of the invention as hereinafter claimed.

What is claimed is:

1. A cup structure for a bra comprising:

a front fabric comprising a first layer of woven cloth and a first layer of foam material affixed to an inner surface of said first layer of woven cloth, a rear fabric comprising a second layer of woven cloth and a second layer of foam material affixed to an inner surface of said second layer of woven cloth, and a soft pad situated between said front fabric and said rear fabric, said soft pad comprises first and second thin film layers containing a fluid therein; wherein an adhesive is applied to an outer surface of said soft pad to fixedly secure said soft pad between said first layer of foam material and said second layer of foam material, and wherein a peripheral edge of said first layer of foam material is directly bonded to said second layer of foam material.

2. The cup structure as claimed in claim 1 wherein:

said first layer of foam material has a width larger than that of said second layer of foam material.

* * * * *